United States Patent [19]

Brilando et al.

[11] 4,291,872

[45] Sep. 29, 1981

[54] ERGOMETRIC EXERCISER WITH FLUID-ACTUATED INDICATOR

[75] Inventors: Frank P. Brilando, Niles; Eugene J. Szymski, Skokie, both of Ill.

[73] Assignee: Excelsior Fitness Equipment Co., Northbrook, Ill.

[21] Appl. No.: 32,242

[22] Filed: Apr. 20, 1979

[51] Int. Cl.[3] ..... A63B 23/04

[52] U.S. Cl. ..... 272/73; 73/862.19; 272/132; 272/DIG. 5

[58] Field of Search ..... 272/73, 130, 131, 132, 272/DIG. 3, DIG. 4, DIG. 5; 73/141 R, 130; 188/24, 72.2

[56] References Cited

U.S. PATENT DOCUMENTS

| | | | |
|---|---|---|---|
| Re. 29,404 | 9/1977 | Blevens | 188/24 |
| 562,198 | 6/1896 | Robinson | 272/73 |
| 2,301,362 | 11/1942 | Brown et al. | 73/130 |
| 2,680,967 | 6/1954 | Newman | 73/141 R X |
| 3,882,971 | 5/1975 | Peckham, Jr. | 188/24 |

FOREIGN PATENT DOCUMENTS

| | | | |
|---|---|---|---|
| 300943 | 11/1928 | United Kingdom | 73/130 |

*Primary Examiner*—Richard C. Pinkham
*Assistant Examiner*—Arnold W. Kramer

[57] ABSTRACT

Bicycle-type ergometric exerciser having pedal-actuated wheel, adjustable caliper brakes engaging the wheel and mounted on a pivoted frame for movement by the wheel according to work input by operator in pedaling wheel, a gauge indicating work rate input, and hydraulic transducer transmitting movement of pivoted frame to the gauge.

8 Claims, 5 Drawing Figures

ERGOMETRIC EXERCISER WITH FLUID-ACTUATED INDICATOR

BACKGROUND OF THE INVENTION

1. Field of the Invention

This invention relates generally to exercise apparatus and, more particularly, to a bicycle-type ergometric exerciser.

2. Description of the Prior Art

Various exerciser devices have been proposed for measuring in one way or another the energy expended by a user. Some employ purely electrical means, such as a motor-generator, with the operator rotating the generator, or pulse generating means and electronic circuitry, but those are unduly expensive. And mechanical apparatus has been provided in the form of a bicycle-type exerciser with a pedal-actuated wheel and caliper brakes engaging the same and movable by the wheel rotation to indicate such movement against the action of a spring, but consistently accurate results cannot be attained with such a spring arrangement, although the latter has the obvious advantage of being very much less expensive than the purely electrical devices.

SUMMARY OF THE INVENTION

This invention obviates the disadvantages of such a spring arrangement by employing with a pedalactuated wheel, adjustable friction brakes which cooperate with the wheel and are mounted on a pivoted frame for movement by the wheel according to the work rate input by the operator in pedaling the wheel, gauge means for indicating that work rate, as in kilogram-meters per minute, or foot-pounds per minute, and a hydraulic transducer for transmitting the movement of the pivoted frame to the gauge means.

This assures accurately indicating the work rate input of the operator with relatively inexpensive means, particularly because of the hydraulic transducer, which eliminates the use of the spring previously referred to and dampens force variations attributed to rim runout. The hydraulic transducer comprises a bellows mounted for compressive application to one end thereof of the force being measured, a small bore tube connected at one end to the other end of the bellows, and a pressure gauge connected to the other end of the tube, with the tube and bellows being filled with a fluid having a low coefficient of cubical expansion.

The only prior patent known which employs an hydraulic transducer in a bicycle-type device is Ser. No. 747,294 of Dec. 15, 1903, but that shows only a pedal-actuated air pump for building up pressure in a tank, which pressure is indicated by a gauge connected to the tank.

DESCRIPTION OF THE PREFERRED EMBODIMENT

Figure 1:
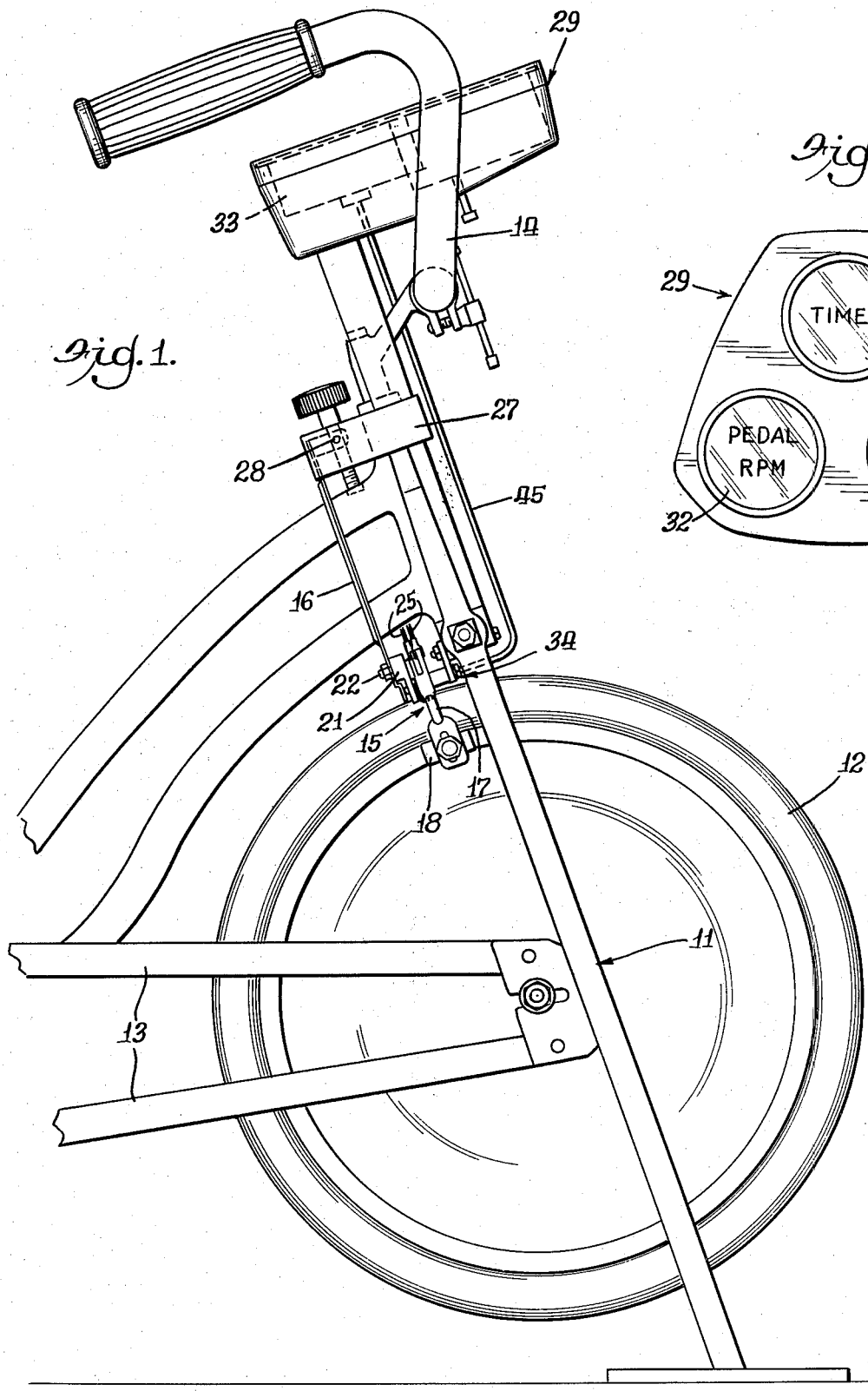
FIG. 1 is a side elevation of a bicycle-type ergometric exerciser embodying the features of the invention, with some parts omitted for the sake of clarity.

The preferred embodiment of the bicycle-type ergometric exerciser herein illustrated includes a suitable stationary support means 11 and a wheel 12 mounted thereon for rotation in well-known manner by pedal means (not shown) actuated by an operator. Such pedal means could be like that shown in U.S. Pat. No. 3,995,491 as including a pedal-actuated drive sprocket and a chain engaging the same and extending within the usual guard, herein designated by reference numeral 13, for rotating a driven sprocket secured to the wheel. The exerciser also includes a suitable handlebar 14 adjustably mounted on the support means 11 for the convenience of the exercising operator.

Figure 2:
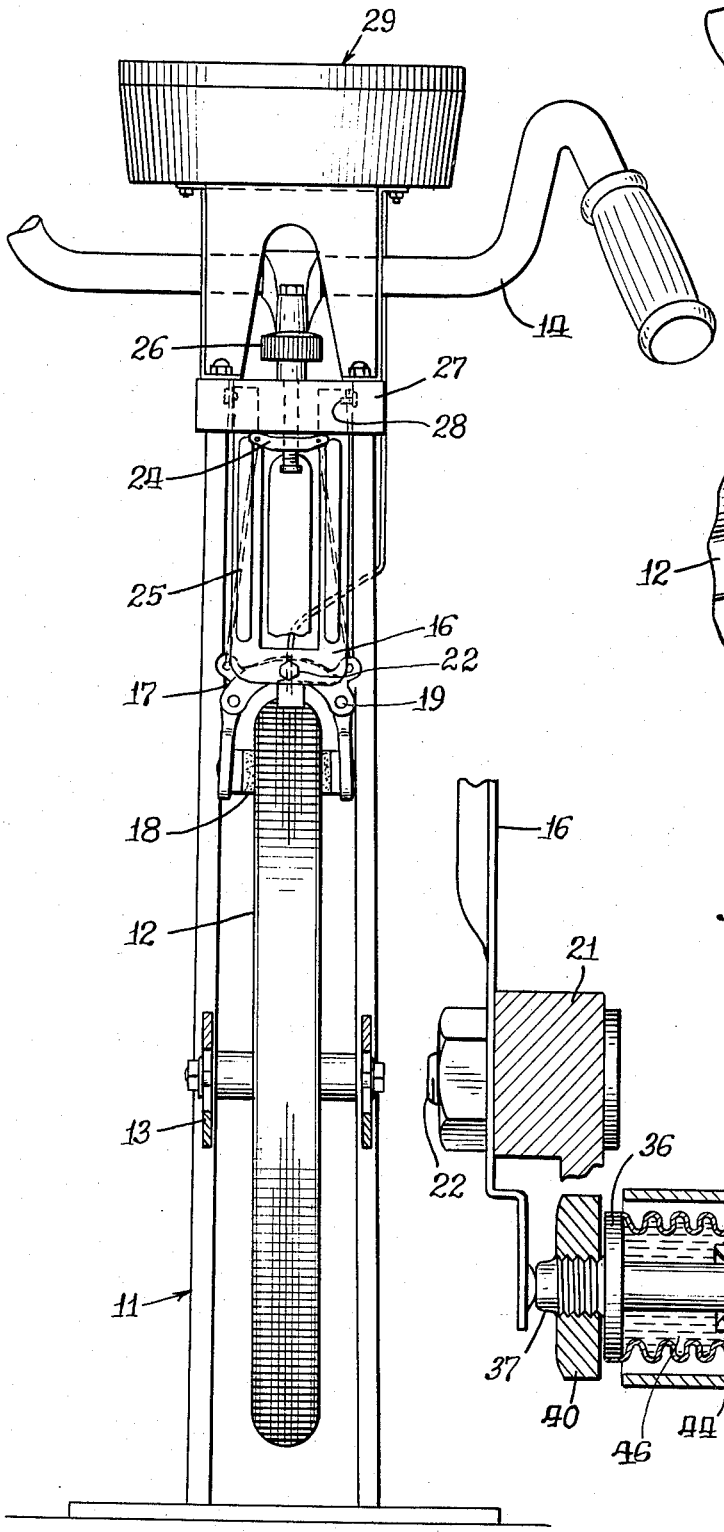
FIG. 2 is an end view, with parts in section, as seen from the left of FIG. 1.
Figure 3:
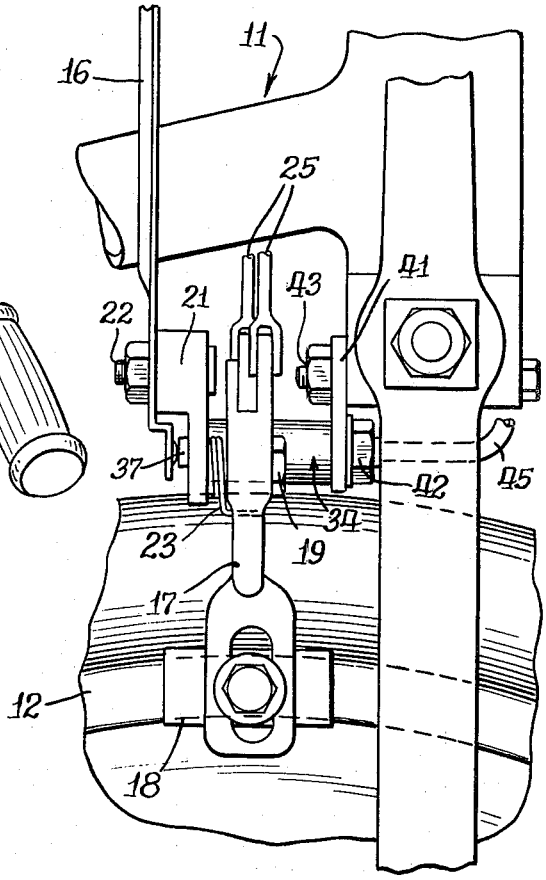
FIG. 3 is a side elevation like FIG. 1 of the adjustable brake means and the hydraulic transducer on an enlarged scale.

In this preferred embodiment, adjustable brake means indicated generally by reference numeral 15 is supported adjacent the lower end of a frame or pivot arm 16 and comprises a pair of caliper brake arms 17 with friction pads 18 on their lower ends engageable with opposite sides of a rim portion of wheel 12. Similar brake arms and friction pads or brake blocks are disclosed in U.S. Pat. No. 3,305,048. The brake arms 17 are pivotally supported at 19 on a stirrup 21 secured adjacent its upper end at 22 to the lower portion of the frame 16, are lightly urged by a spring 23 (FIG. 3) away from each other and the wheel rim, and are adjustably moved and held in frictional engagement with the wheel by a threaded yoke 24 (FIG. 2) interconnected, respectively, with the upper ends of the two brake arms 17 by rods 25. The threaded yoke 24 is supported and moved vertically by a brake pressure adjusting screw 26 suitably supported in turn by a bracket 27 mounted on the support means 11. Thus, lifting of the threaded yoke 24 in response to rotation of the adjusting screw 26 will frictionally engage the caliper brake pads 18 with the opposite sides of the rim portion of wheel 12.

The upper ends of the frame or pivot arm 16 (FIGS. 1 and 2) are pivotally supported at 28 in the bracket 27. Consequently, if the wheel 12 is being rotated by the operator in a clockwise direction, as viewed in FIGS. 1 and 3, and the caliper brake means 15 has been adjusted by screw 26 to frictionally engage the rim of wheel 12, the lower end of the frame or arm 16 and the stirrup 21 thereon will be moved to the right in those views in accordance with the work rate input being exerted by the operator.

Instrument panel means, indicated generally by reference numeral 29, is mounted on the support means 11 in any suitable manner at a position centrally of the handlebar 14 to conveniently indicate to the operator such work rate input resulting from the pressure being maintained against the rim of the wheel 12 by the brake means 15 as the wheel is rotated by the operator. That instrument panel or guage means preferably includes a timer 31 of any desired type (FIG. 1A), a wheel or pedal RPM indicator 32 operable in well-known manner by the pedals or wheel, and an hydraulically operated load indicator 33 to show, as in kilogram-meters per minute, or foot-pounds per minute, the energy being expended by the operator.

Figure 4:
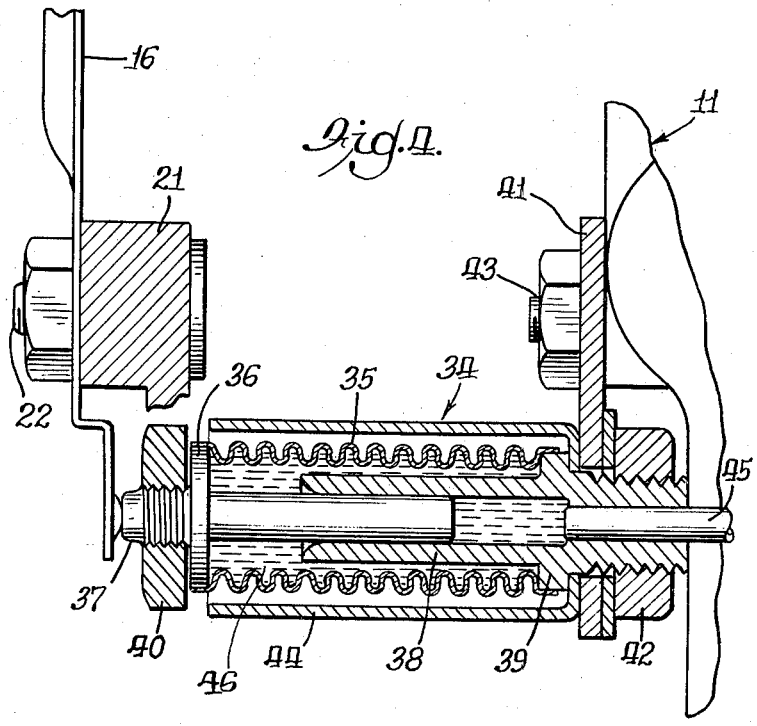
FIG. 4 is a detail vertical section on a still larger scale taken longitudinally through the hydraulic transducer.

The indicator 33 is actuated by hydraulic transducer means indicated generally by reference numeral 34 which in the preferred embodiment includes an hydraulic load cell in the form of a bellows 35 best seen in FIG. 4. The first, rear or left end of the bellows is secured to the periphery of, and sealingly closed by, a flange 36 of a load-receiving shaft 37, as by silver soldering. The outer end of shaft 37 extends beyond the stirrup 21 and is contacted by the lower end portion of the frame or pivot arm 16. An inner or forward extension of the shaft 37 slidably engages matingly within an inner tubular end of a guide fitting 38. The guide fitting 38 is provided with an intermediate flange 39 which seals and is secured to the second, forward or right end of the bellows 35 in similar manner to the attachment of its rear end to the flange 36. The outer or right end of the guide fitting 38 is threaded and extends through a suitable aperture in a mounting plate 41 to receive a nut 42 for securing the fitting and the forward end of the bellows 35 to the mounting plate which, in turn, is mounted on the stationary support means 11, as by a nut and bolt 43.

Surrounding the bellows 35 in circumferentially spaced relationship is a protective cup 44 having an apertured base secured between the flange 39 and the mounting plate 41 by the nut 42. The open or rear end of the cup 44 is spaced a predetermined distance from an adjustable nut 40 screwed onto a threaded outer portion of shaft 37 to permit rightward or forward compressive movement of the bellows in response to movement of the load-receiving shaft 37 by the pivot arm or frame 16, and then to function as a stop to limit such force application and prevent overstressing of the hydraulic transducer 34 or the pressure gauge or load indicator 33. It will be understood that after assembly or mounting of the transducer 34 and the frame 16 on the support means 11, the nut 40 may be adjusted to position it the desired distance from the end of the cup 44 and then secured in that position in any suitable manner, as by soldering to shaft 37. It also will be appreciated that the shaft 37 and the mating fitting 38 comprise guide means to prevent rubbing of the bellows 35 against its protective cup 44 and resulting premature failure of the bellows.

Figure 1A:
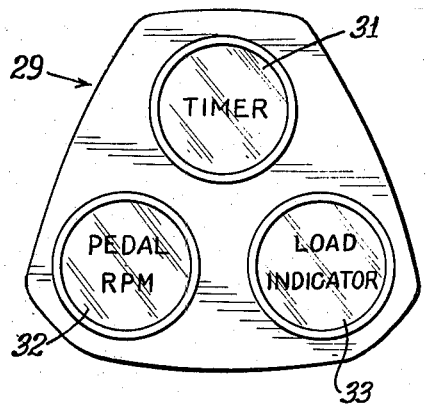
FIG. 1A is a top plan view of gauge means to indicate the work rate input of an operator.

The lower end of a small gauge tube 45 is inserted into the outer portion of the guide fitting 38 and sealed therein, preferably with silver solder, and the upper end of the tube is similarly attached to the load indicator 33 (FIG. 1). The tube 45, interior of bellows 35 and the pressure gauge or load indicator 33 are evacuated and then filled in well-known manner with a viscous fluid 46 having a low coefficient of cubical expansion, such as Dow Corning fluid identified as DC-550. This is sufficiently viscous to dampen any force variations attributed to rim runout, and it will not damage floors, or the like, in the event of leakage. Thus, whenever the lower end of the frame or pivot arm 16 is moved forwardly in response to the operator rotating wheel 12 with the pads 18 of the adjustable brake means 15 frictionally engaging the wheel rim, as previously described, a very accurate readout of the resistance load against which the person on the exerciser has to work will be given by the gauge or indicator 33 by virtue of the resulting actuation of the hydraulic transducer 34.

It is thought that the invention will be understood from the foregoing description and it will be apparent that various changes may be made in the form, arrangement and construction of the various parts described without departing from the spirit and scope of the invention or sacrificing all of its material advantages, the form hereinbefore described being merely a preferred embodiment thereof.

The embodiments of the invention in which an exclusive property or privilege is claimed are defined as follows:

1. A bicycle-type ergometric exerciser, comprising support means, a wheel rotatably mounted on said support means, pedal means actuated by an operator to rotate said wheel, a frame mounted on said support means for movement relative thereto, adjustable brake means mounted on said frame for frictionally engaging said wheel and moving said frame in response to rotation of said wheel in accordance with the work rate input by an operator in actuating said pedal means, gauge means for indicating said work rate input, and hydraulic transducer means transmitting the movement of said frame to said gauge means.

2. A bicycle-type ergometric exerciser according to claim 1, wherein said frame is pivotally mounted on said support means.

3. A bicycle-type ergometric exerciser according to claim 1, wherein said hydraulic transducer means comprises a bellows mounted on said support means for compressive application at a first end thereof by said frame in accordance with said work rate input.

4. A bicycle-type ergometric exerciser according to claim 3, wherein said hydraulic transducer comprises a small bore tube sealingly interconnected between a second end of said bellows and said gauge means and completely filled with a fluid having a low coefficient of cubical expansion.

5. In a bicycle-type ergometric exerciser according to claim 4, a protective cup surrounding said bellows and having a base mounted on said support means and an open end disposed as a stop to prevent overstressing of said gauge means.

6. In a bicycle-type ergometric exerciser having support means, a wheel rotatable on said support means by an operator, a frame mounted on said support means for movement relative thereto, adjustable brake means frictionally engaging said wheel to move said frame in response to rotation of said wheel in accordance with the work rate input by an operator, and gauge means for indicating said work rate input; hydraulic transducer means transmitting such movement of said frame to said gauge means, comprising a bellows mounted on said support means for compressive force application at a first end thereof by said frame in accordance with said work rate input.

7. A bicycle-type ergometric exerciser according to claim 6, wherein said hydraulic transducer comprises a small bore tube interconnected between a second end of said bellows and said gauge means.

8. A bicycle-type ergometric exerciser according to claim 6, wherein said hydraulic transducer comprises a protective cup surrounding said bellows and having a base mounted on said support means and an end disposed as a stop to limit compressive force application by said frame against said bellows.

* * * * *